US006755917B2

(12) United States Patent
Hardin et al.

(10) Patent No.: US 6,755,917 B2
(45) Date of Patent: Jun. 29, 2004

(54) PROCESS AND SOLUTION FOR PROVIDING A CONVERSION COATING ON A METALLIC SURFACE II

(75) Inventors: Simon Gerard Hardin, North Fitzroy (AU); Klaus Werner Wittel, Frankfurt (DE); Anthony Ewart Hughes, Olinda (AU); Karen Joy Hammon Nelson, Plympton (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 9 days.

(21) Appl. No.: 09/988,579

(22) Filed: Nov. 20, 2001

(65) Prior Publication Data

US 2002/0096230 A1 Jul. 25, 2002

Related U.S. Application Data

(63) Continuation of application No. PCT/AU01/00312, filed on Mar. 20, 2001.

(30) Foreign Application Priority Data

Mar. 20, 2000 (AU) ..... PQ6333

(51) Int. Cl.[7] ..... C23C 22/00

(52) U.S. Cl. ..... 148/243; 148/272; 148/273; 148/275; 106/14.21; 252/387

(58) Field of Search ..... 148/243, 272, 148/273, 275; 106/14.21; 252/387

(56) References Cited

U.S. PATENT DOCUMENTS

| | | | | |
|---|---|---|---|---|
| 3,969,152 | A | 7/1976 | Melotik | 148/6.15 |
| 4,233,088 | A | 11/1980 | Kronstein | 148/6.16 |
| 4,264,278 | A | 4/1981 | Weingart | 416/226 |
| 4,298,404 | A | 11/1981 | Greene | 148/6.14 |
| 4,310,390 | A | 1/1982 | Bradley et al. | 204/37 |
| 4,349,392 | A | 9/1982 | Huvar | 148/6.2 |
| 4,359,347 | A | 11/1982 | Da Fonte, Jr. | 148/6.14 |
| 4,610,732 | A | 9/1986 | Sasaki et al. | 148/6.14 |
| 4,711,667 | A | 12/1987 | Bibber | 106/14.2 |
| 4,725,375 | A | 2/1988 | Fujii et al. | 252/79.4 |
| 4,755,224 | A | 7/1988 | Bibber | 106/14.2 |
| 4,851,148 | A | 7/1989 | Yamasoe et al. | 252/142 |
| 4,878,963 | A | 11/1989 | Bibber | 148/262 |
| 4,883,541 | A | 11/1989 | Tadros | 134/3 |
| 4,921,552 | A | 5/1990 | Sander et al. | 148/247 |
| 4,944,889 | A | 7/1990 | Awad | 252/32.5 |
| 4,988,396 | A | 1/1991 | Bibber | 148/269 |
| 5,030,323 | A | 7/1991 | Awad | 156/665 |
| 5,080,814 | A | 1/1992 | Awad | 252/49.3 |
| 5,118,356 | A | 6/1992 | Darmon et al. | 134/3 |
| 5,192,374 | A | 3/1993 | Kindler | 148/272 |
| 5,194,138 | A | 3/1993 | Mansfeld et al. | 205/183 |
| 5,198,141 | A | 3/1993 | Darmon et al. | 252/142 |
| 5,221,371 | A | 6/1993 | Miller | 148/273 |
| 5,356,492 | A | 10/1994 | Miller | 148/273 |
| 5,356,942 | A | 10/1994 | Savoca et al. | 521/103 |
| 5,362,335 | A | 11/1994 | Rungta | 148/272 |
| 5,383,982 | A | 1/1995 | Hauffe et al. | 148/262 |
| 5,389,199 | A | 2/1995 | Awad et al. | 156/665 |
| 5,520,750 | A | 5/1996 | Riley | 148/261 |
| 5,584,943 | A | 12/1996 | Banaszak et al. | 148/246 |
| 6,022,425 | A | 2/2000 | Nelson et al. | 148/272 |
| 6,206,982 | B1 | 3/2001 | Hughes et al. | 148/273 |
| 6,503,565 | B1 | 1/2003 | Hughes et al. | 427/299 |

FOREIGN PATENT DOCUMENTS

| | | |
|---|---|---|
| AU | 24808/84 | 2/1984 |
| AU | 228552/92 | 3/1993 |
| EP | 0127572 | 12/1984 |
| EP | 0331284 | 9/1989 |
| EP | 0367504 | 5/1990 |
| EP | 0486778 | 5/1992 |
| EP | 0488430 | 6/1992 |
| EP | 0603921 | 6/1994 |
| EP | 0694593 | 1/1996 |
| EP | 0760401 A1 | 3/1997 |
| EP | 0769080 | 9/2000 |
| GB | 1368230 | 9/1974 |
| GB | 2059445 | 4/1981 |
| GB | 2097024 A | 10/1982 |
| WO | WO88/06639 | 9/1988 |
| WO | WO95/08008 | 3/1995 |
| WO | WO95/34693 | 12/1995 |
| WO | WO96/11290 | 4/1996 |
| WO | WO96/15292 | 5/1996 |
| WO | WO99/46422 | 9/1999 |

OTHER PUBLICATIONS

Chemical and Engineering News, 63 (5), 27, 1985 Periodic Table (no month data).

Derwent Abstract Accession No. 99–233263/20, JP 11061432 (Nippon Steel Corp), Mar. 5, 1999.

139 Galvanotechnik 85 (1994), Jun., No. 6, Saulgau (Wurtt.), DE Abstract.

Arnott et al, Applns of Surface Science 22/23, 1985, pp. 236–251, Auger and XPS Studies of Cerium Corrosion Inhibition . . . .

King, Surface Treatment and Finishing of Aluminum, Chapter 6, 1988, pp. 51–58, Conversion Coatings as Pretreatments for . . . .

Abstract, Bibber, Corrosion resistant vonversion coating prepn. for aluminum alloys—by typically treating alloy with . . . .

*Primary Examiner*—Roy King
*Assistant Examiner*—Andrew L. Oltmans
(74) *Attorney, Agent, or Firm*—Jacobson Holman PLLC

(57) ABSTRACT

An aqueous acidic solution for forming a conversion coating on the surface of a metallic material, said solution containing at least one rare earth element (as herein defined) containing species, an accelerator additive selected from the group consisting of metals of Group IB, IIB, IVA, VA, VIA and VIII of the Periodic Table, a peroxidic species and at least one acid selected from the group of mineral acids, carboxylic acids, sulphonic acids and phosphonic acids, wherein said solution contains no more than 20 mg/liter each of fluoride and of phosphate, and the solution is essentially free of chromate.

24 Claims, No Drawings

PROCESS AND SOLUTION FOR PROVIDING A CONVERSION COATING ON A METALLIC SURFACE II

This is a continuation application of PCT/AU01/00312, filed Mar. 20, 2001, and published in English.

FIELD OF THE INVENTION

This invention relates to a surface treated part with a conversion coating formed on a metallic surface and to a process for forming this conversion coating, to a liquid aqueous concentrate for the make-up for the replenishing of a conversion coating solution as well as to a solution for forming a conversion coating on surfaces of metallic materials. The invention is particularly concerned with a conversion coating on aluminum, aluminum alloy, magnesium, magnesium alloy, zinc or zinc alloy and a process, a concentrate and a solution for the formation of a conversion coating on parts of these metallic materials.

BACKGROUND OF THE INVENTION

The term "conversion coating" is a well known term of the art and refers to the replacement of native oxide on the surface of a metallic material by the controlled chemical formation of a film. Oxides, chromates or phosphates are common conversion coatings. Conversion coatings are used on metallic materials such as steel or aluminum, zinc, cadmium, magnesium and their alloys, and provide a key for paint adhesion and/or corrosion protection of the metallic substrate. Accordingly, conversion coatings find application in such areas as aerospace, automotive, architectural, and packaging.

Known methods for applying conversion coatings to metallic surfaces include treatment with chromate or phosphate solutions, or mixtures thereof. However, in recent years it has been recognized that the hexavalent chromium ion, $Cr^{6+}$, is a serious environmental and health hazard. Similarly, phosphate ions pose a considerable risk, particularly when they find their way into natural waterways and cause algal blooms. Consequently, strict restrictions have been placed on the quantity of these species used in a number of industrial processes and limitations have been placed on their release to the environment. This leads to costly effluent processing.

In the search for alternative, less toxic conversion coatings, research has been conducted on conversion coatings based on rare earth compounds. However, there is considerable room for improvement in the adhesion and corrosion protection properties of prior rare earth element (hereinafter referred to as "REE") based conversion coatings and in the time required to deposit those coatings. The need for improvement is particularly true for conversion coatings on certain metal alloys, such as 3000, 5000 and 6000 series aluminum alloys, which coatings can be slow to deposit and have variable adherence or no adherence.

It is also very important to develop conversion coating solutions and processes which are compatible with existing coating apparatus and equipment used in the art. In particular, the use of stainless steel containers to hold conversion coating solutions is prevalent in the conversion coating industry. Typically much money and infrastructure has been invested in such equipment and it is often impractical and/or prohibitively expensive to replace it.

WO 88/06639 teaches a process for forming a conversion coating on metal using a cerium containing conversion coating solution. However, it has been found that said process does not produce acceptable coatings on alloys of the 3000, 5000 and 6000 series of aluminum alloys within the time needed for industrial coating, that means within much less than five minutes. Moreover, this process requires a specified initial chloride content which increases in the bath over the course of the process. It has been found that the initial and increasing chloride content in the bath adversely affects stainless steel containers by considerable corrosion attack.

WO 96/15292 describes a REE containing conversion coating and a process for its formation using a solution containing REE and additives selected from (i) metal peroxo complexes in which the metal is selected from Groups IVB, VB, VIB and VIIB; and (ii) metal salts or complexes with a conjugate base of an acid in which the metal is selected from Transition Elements other than chromium especially copper, silver, manganese, zinc, iron, ruthenium and Group IVA elements, especially tin. The solution preferably includes hydrogen peroxide. Good results were obtained using the additive Cu alone or in combination with Mn, Ti-peroxo complexes and/or Mo-peroxo complexes. However, it has been found that the use of two different accelerators creates difficulties in controlling the process, particularly when it is used on an industrial scale. In all the other examples disclosed in W096/15292 a time for applying the solution was needed which was much longer than the typical time required in current industrial practice, i.e. from about 1 to 3 minutes. Moreover, while anions other than chloride are mentioned in WO 96/15292, only chloride containing solutions were disclosed and the concentrations of chloride in those solutions have been found to cause corrosion attack of stainless steel equipment.

Examples 13 to 15 of WO 96/15292 indicate in comparison to examples 7 to 12 and 16 to 27 that optimum results are obtained in a very narrow window of conditions, i.e. a pH value only of 2.3 and a relatively high copper content of about 100 ppm. These optimum conditions however, are quite problematic. The pH value of 2.3 is quite high with the result that the solution is close to the stability limit of the trivalent REE ions. For example, the oxidation of $Ce^{3+}$ to $Ce^{4+}$ is pH dependent and is favoured at higher pH values. If pH increases to 2.5 and above, formation of insoluble Ce(IV) compounds occurs. This means that REE compounds are already precipitating out of solution, causing sludge in the bath and thus further costs are required to remove it. Moreover, a copper content of about 100 mg/l causes the rapid catalytic decomposition of hydrogen peroxide to water and oxygen requiring replenishment of $H_2O_2$ which leads to increasing costs and a considerable dilution of the solution.

Over the years there have been numerous attempts to replace chromating chemicals by ones less hazardous to health and the environment. One major disadvantage of the replacement solutions is that they form colourless conversion coatings, e.g. Gardobond 764®, which is based on zirconium fluoride. Coloured conversion coatings are highly desirable from a practical point of view as they give a readily visible indication of the presence of a coating and its quality.

Another major disadvantage of prior replacement solutions is that they have required very long treatment times, like the chemical oxidation process described in EP-A-0 769 080. Zirconium and titanium based conversion coating processes have found some applications in certain market niches, but they have failed in the past 25 years to replace chromating as a pre-treatment prior to painting of aluminum, magnesium, zinc or their alloys.

Accordingly, it is an object of the present invention to provide a conversion coating for the surface of a metallic material which overcomes, or at least alleviates, one or more of the disadvantages or deficiencies of the prior art. It is also an object of the present invention to provide an aqueous, rare earth element containing conversion coating solution for use in providing a conversion coating on a metallic surface. It is a further object to provide a process for forming a conversion coating on the surface of a metallic material which overcomes, or at least alleviates, one or more of the disadvantages of the prior art.

Advantages of this invention include the provision of a process and a solution which can meet the industrial requirements of 1. formation of the coating in a short time, 2. the generation of coloured coatings of high adhesion and coating quality, and 3. solutions which may be used in stainless steel containers.

It has been discovered that the careful selection of additives, to the coating solution can assist in accelerating the coating process, improving the coating quality, and/or the adhesion of the conversion coating to the metal surface, without causing corrosion of stainless steel containers.

Throughout the specification, reference will be to the CAS version of the Periodic Table, as defined in (for example) Chemical and Engineering News, 63(5), 27, 1985. Furthermore, as used herein, the term "rare earth" elements or ions, or "REE" refers to the elements of the Lanthanide series, namely those having the atomic number 57 to 71 (La to Lu), plus scandium and yttrium. Moreover, as used herein, the term "peroxidic compound" refers to any of the group of peroxo acids and their salts or any peroxo containing compound such as hydrogen peroxide. Also, the expression: "metals of Groups IB, IIB, IVA, VA, VIA, and VIII of the Periodic Table" refers to both metals and metalloids of each group. It explicitly covers the elements Cu, Ag, Au, Zn, Cd, Hg, Si, Ge, Sn, Pb, As, Sb, Bi, Se, Te, Po, Fe, Ru, Os, Co, Rh, Ir, Ni, Pd and Pt. Further, the generic term "part" is intended to cover any body or component of any shape or size having at least one metallic surface thereon.

SUMMARY OF THE INVENTION

According to the present invention, there is provided an aqueous, acidic solution for forming a conversion coating on the surface of a metallic material, said solution containing at least one rare earth element (as herein defined) containing species, an accelerator additive selected from the group consisting of metals of Groups IB, IIB, IVA, VA, VIA and VII of the Periodic Table, a peroxidic species, and at least one acid selected from the group of mineral acids, carboxylic acids, sulphonic acids and phosphonic acids, wherein said solution contains no more than 20 mg/l each of fluoride and of phosphate, preferably no more than 10 mg/l each, and the solution is essentially free of chromate. Preferably the amount of chloride containing species present in the coating solution is controlled so that the concentration of total chloride is within the range of from 50 to 1500 mg/l.

According to the present invention, there is also provided a process for forming a conversion coating on the surface of a metallic material including the step of contacting said surface with an aqueous, acidic conversion coating solution containing at least one rare earth element (as herein defined) containing species, an accelerator additive selected from the group consisting of metals of Groups IB, IIB, IVA, VA, VIA and VII of the Periodic Table, a peroxidic species, and at least one acid selected from the group of mineral acids, carboxylic acids, sulphonic acids and phosphonic acids, wherein said solution contains no more than 20 mg/l of each of fluoride and of phosphate, and the solution is essentially free of chromate. Preferably, the amount of chloride present in the coating solution is controlled to be within the range of from 50 to 1500 mg/l.

The present invention also provides a surface treated part including a metallic material having a conversion coating thereon resulting from treatment with the aqueous, acidic conversion coating solution of the invention. The treated part may additionally bear a coating of a paint, a lubricant and/or a sealant. The treated part may be subsequently used in a process involving cold forming, glueing, welding and/or other joining processes. The conversion coating preferably contains at least 5% by weight of a rare earth compound.

The present invention also provides a liquid acidic aqueous concentrate for the make-up of a conversion coating solution according to the invention wherein the concentrate contains at least 80 g/l and preferably at least 100 g/l of total rare earth elements (as herein defined), an accelerator selected from the group consisting of metals of Groups IB, IIB, IVA, VA, VIA and VIII of the Periodic Table, and at least one acid selected from the group of mineral acids, carboxylic acids, sulphonic acids and phosphonic acids, wherein the concentrate contains no more than 100 mg/l each of fluoride and of phosphate and the solution contains essentially no chromate.

The present invention also provides a liquid acidic aqueous concentrate for the replenishing of a conversion coating solution according to the invention, wherein the concentrate contains rare earth ions (as herein defined) and monovalent anions in a molar ratio of total rare earth ions:monovalent anions of from 1:200 to 1:6 and/or rare earth ions and divalent anions in a molar ratio of total rare earth ions:divalent anions of from 1:100 to 1:3 and/or the concentrate contains at least one metal selected from Groups IB, IIB, IVA, VA, VIA and VII, preferably from the group of Cu, Ag, Au, Cd, Hg, Ni, Pd, Pt, Co, Rh, Ir, Ru, Os, Sn, Pb, Sb, Bi, Se and Te and anions such that the molar ratio of the sum of the elements in this group: anions is in the range from 1:50 to 1:10,000.

Preferably the accelerator additive is selected from the elements Cu, Ag, Au, Cd, Hg, Ni, Pd, Pt, Co, Rh, Ir, Ru, Os, Sn, Pb, Sb, Bi, Se and Te. The most preferred accelerator additive is Cu.

The at least one acid is preferably selected from the group comprising sulphuric acid, sulphamic acid, hydrochloric acid, nitric acid, perchloric acid, carboxylic acids, alkyl sulphonic acids, aryl sulphonic acids, alkyl phosphonic acids, and aryl phosphonic acids.

DETAILED DESCRIPTION OF THE PREFERRED EMBODIMENTS

It has been discovered that the addition of any metal of Groups IB, IIB, IVA, VA, VIA and VIII of the Periodic Table, preferably of the group comprising Cu, Ag, Au, Cd, Hg, Ni, Pd, Pt, Co, Rh, Ir, Ru, Os, Sn, Pb, Sb, Bi, Se and Te, especially of copper, and the addition of at least REE, any peroxo compound like hydrogen peroxide and at least one anion such as sulphate or sulphamate to an aqueous acidic conversion coating solution results within short time in homogeneous, dense, conversion coatings with good adherence to the substrate and corrosion resistance.

Surprisingly it was found that the process of the invention can work in some cases without a considerable loss of the peroxidic compound(s) added and that the corrosion of the stainless steel in contact with the conversion coating solution can be limited to practically zero, if the chloride content is controlled to within a specified range. Furthermore, it is an advantage of the process of the invention that only one accelerator additive besides REE need be added to the solution, instead of a combination of elements as required in the prior art, which has to be controlled carefully.

The invention will now be described with particular reference to its use for aluminum, aluminum alloys, magnesium, magnesium alloys, zinc or zinc alloys. In particular, the metallic material to be primarily discussed in the following are aluminum and aluminum alloys, particularly aluminum alloys of the 3000, 5000 and 6000 series. However, a skilled addressee will understand that the invention is not limited to this use and can be used in relation to other metallic materials, such as steel.

The surface treated part of the present invention may exist in any shape, such as tubes, wires, sheets ingots, profiles or coils.

The conversion coating step may form part of an overall metal treatment process which may include one or more of the following steps:

cleaning, preferably with an aqueous, alkaline cleaner, pickling, usually in a strongly alkaline solution, deoxidizing, usually in an acidic solution, conversion coating, final rinsing, preferably with de-ionized water and/or special sealants.

All of these steps should preferably be separated by one or more steps of rinsing with water thus reducing carry-over of processing chemicals into the next treatment stage. Accordingly, the conversion coating process may comprise at least one of at least two successive treatments, including passivation treatments.

The pickling may be done with an alkaline solution, such as one containing caustic soda solution and a gluconate. The deoxidizing/desmutting may be carried out with an acidic solution, such as containing nitric acid and hydrofluoric acid or containing hydrofluoric acid and phosphoric acid or containing sodium bifluoride or containing $Fe^{3+}$ and sulphuric acid or containing $Fe^{3+}$ and nitric acid.

Considering the demand of a chromate-free conversion coating, standard chromate containing deoxidizers would not be recommended to be used in a process according to this invention. Another, relatively new possibility is the use of a REE based deoxidizer as described in WO 95/08008 A1.

If the steps of cleaning, pickling and deoxidizing are used, a clean metallic surface is prepared, free from dirt, oil and greases, as free as possible from oxides, and therefore very reactive towards the conversion coating step itself. The specific chemistry and process conditions will depend very much on the state of the metal surface which is to be treated. A heavily oxidized aluminum surface, for instance, certainly will require a pickling step to remove the thick oxide layer from the surface.

The conversion coating solution forms a thin layer on the metallic surface. The corrosion protecting properties of this coating may be further improved by adding a sealant to the final rinsing solution. Suitable sealants may be based on silicates, phosphates, silanes, fluorotitanates or fluorozirconates, special polymers like polyvinylphenole derivatives or, sometimes modified, polyacrylates. As with the deoxidizer, the well-known chromate containing sealants could be used in principle, yet may be undesirable in an otherwise chromate-free process.

The conversion coating solution may contain ions and/or at least one complex species of one or a mixture of REE. There may be a REE distribution which results from the natural raw materials used, such as that of mischmetal. Alternatively, a refined fraction of REE may be used, e.g. cerium with a purity of greater than 95%. The ratio of cerium to total REE may be at least 5% by weight, preferably at least 30% by weight, particularly preferred at least 60% by weight. Throughout the specification, unless otherwise specified, the values of concentration of rare earth ions in g/l are usually expressed as the molar equivalent grams of cerium per liter of solution. The coating solution may contain ions and/or at least one complex species of REE in a concentration ranging from smallest additions to the solubility limit. The concentration is preferably in the range of from 0.5 to 1000 g/l of REE, more preferred 1 to 60 g/l of REE, particularly preferred 2 to 30 g/l of REE. In the case where very short treatment times are required, e.g. 1 to 20 seconds, there may be the need to have a higher REE content such as in a range of from 120 to 600 g/l, preferably in the range of from 150 to 240 g/l. In other embodiments, the rare earth ion and/or complex is typically present in the coating solution at a concentration below 50 g/l, such as up to 40 g/l or up to 38 g/l. More preferably, this concentration is below 32 g/l. The preferred lower concentration limit may be 0.038 g/l, such as 0.38 g/l or even 3.8 g/l and above. In a particularly preferred embodiment, the solution contains up to 0.6 mol/l of cerium, preferably of from 0.01 to 0.5 mol/l of cerium, preferably of from 0.05 to 0.4 mol/l of cerium. Nevertheless, a lower content of the REE is preferred in many cases because of costs.

It is further particularly preferred that the cerium be present in the solution as $Ce^{3+}$ cations and/or complexes. While not wishing to be restricted to a particular mechanism of reaction, it is believed that when the metallic surface is reacted with the coating solution, the resulting pH values increase at the metallic surface, which results in a precipitation of a cerium (IV) containing compound on the metallic surface as there is a peroxidic compound present. However, the cerium may be present in the solution as $Ce^{4+}$, too, as $Ce^{3+}$ is oxidized in the presence of a peroxidic compound at a suitably high pH. Cerium may be precipitated in the conversion coating as hydroxide, oxide, peroxide, or salt, preferably as a cerium (IV) compound. Generally, yellowish to orange coatings can be found when using cerium compounds, whereby the colour depends of the thickness of the coating. A certain cerium content and/or content of at least one other REE creating a coloured conversion coating such as Pr, Nd, Sm, Eu, Tb, Dy, Ho, Er or Tm, or their mixtures may be preferred to be able to control the quality of the formed conversion coating visually.

It is particularly preferred that the REE be introduced into the coating solution in the form of a soluble salt, such as a cerium (III) containing chloride, cerium (III) containing sulphate, cerium (III) containing sulphamate or cerium (III) containing nitrate.

The REE may be introduced into the conversion coating solution by dissolving any REE containing compound or metal or any mixture of these in any acid or acid mixture. Preferably, the REE containing compound is a metal, alloy, oxide, hydroxide or carbonate which may be dissolved in an acid like hydrochloric acid or in a mixture of acids. Particularly preferred starting materials are mischmetal, cerium containing oxides, cerium containing hydroxides and cerium containing carbonates.

The conversion coating solution preferably contains up to 10 g/l of an accelerator additive, comprising at least one of the metals of Groups IB, IIB, IVA, VA, VIA and VIII of the Periodic Table, preferably of the group of Cu, Ag, Au, Cd, Hg, Ni, Pd, Pt, Co, Rh, Ir, Ru, Os, Sn, Pb, Sb, Bi, Se and Te. The concentration of at least one of these metals may be in the range of from 0.001 to 1 g/l, preferably of from 0.005 to 0.1 g/l, particularly preferred of from 0.01 to 0.06 g/l. The total concentration of these elements can range from 0.0001 to 0.15 g/l. In one embodiment, the total concentration of these elements may be up to 50 mmol/l, preferably from 0.001 to 20 mmol/l. Particularly preferred accelerator additives are elements of the group of Cu, Ag, Sn, Pb, Sb, Bi, Se and Te, typically in a concentration range from 0.01 to 5 mmol/l, preferably from 0.02 to 5 mmol/l. It may be desirable that the solution contains one or more of these elements, particularly at a concentration of from 0.01 to 5 mmol/l, especially preferred of from 0.1 to 1 mmol/l. However, it is an advantage of the invention that only one accelerator additive need be added to solution in order to obtain an effective conversion coating solution, which can thereby simplify and reduces the cost of making the solution. The accelerator additive/s may be present in the coating solution as complexed species. It is preferred that the concentration of complexed species containing one or more of Cu, Ag, Au, Cd, Hg, Ni, Pd, Pt, Co, Rh, Ir, Ru, Os, Sn, Pb, Sb, Bi, Se and Te is in a range of from 0.01 to 10 mmol/l. The accelerator additive, either as an element or a complexed species, seems to function as a coating accelerator although the details of the influence of these additions are not yet fully understood. In some instances, the accelerator additive/s can form part of the coating, however they are present in the coating at a very low concentration only. The addition of the accelerator additive/s in low concentrations is preferred in many cases in order to minimise costs.

An especially preferred accelerator additive is copper, present as ions or in a complex, preferably at a concentration of between 0.01 to 5 mmol/l.

The conversion coating solution contains at least one oxidant, preferably any peroxidic compound of the group of peroxo acids, their salts and peroxides. The oxidant is preferably hydrogen peroxide as there are no environmental risks associated with the use of hydrogen peroxide. The coating solution may contain up to 340 g/l of hydrogen peroxide or equivalent amounts of any peroxidic compound, calculated as hydrogen peroxide. The concentration is preferably of from 1 to 200 g/l, more preferably from 1 to 100 g/l, particularly preferred of from 2 to 50 g/l or even more preferably of from 3.4 to 34 g/l. The solution may contain up to 10 mol/l of hydrogen peroxide or equivalent amounts of any peroxidic compound, preferably of from 0.01 to 6 mol/l, particularly preferred of from 0.1 to 1 mol/l. Nevertheless, a lower content of the peroxidic compound is preferred in many cases because of costs.

The conversion coating solution may contain at least one complexing agent which complexes and/or is already complexed with the one or more accelerator additives selected from Groups IB, IIB, IVA, VA, VIA and VIII, especially from the group of chemical elements of Cu, Ag, Au, Cd, Hg, Ni, Pd, Pt, Co, Rh, Ir, Ru, Os, Sn, Pb, Sb, Bi, Se and Te. In many cases, it depends on the identity of the accelerator additive whether the elements selected from the group of metals of Cu, Ag, Au, Cd, Hg, Ni, Pd, Pt, Co, Rh, Ir, Ru, Os, Sn, Pb, Sb, Bi, Se and Te should be complexed or not. In many cases it is desirable that the accelerator additives Ag, Sb, Bi, Sn, Pb, Se and/or Te should be present as complexes and that the accelerator additive Cu should not be present as a complex. For some complexes there is an inherent danger that after a precipitation treatment of the rinse waters with lime the effluent limits might be exceeded. This is specifically true for Cu complexes. But if the Cu should be present in the form of a complex, it is preferred to use amino carboxylic compounds like glycine or alanine as the complexing agent. Where the accelerator additive is other than Cu and is present as a complex, preferably the complexing agent is of the group of polyaminocarboxylic acids, such as ethylenediaminetetraacetic acid (EDTA), nitrilotracetic acid (NTA), hydroxyethylethylenediaminetriacetic acid (HEDTA) and/or their corresponding salts. Preferably, the complex is present at a concentration in the range of from 0.01 to 10 mmol/l.

In many cases, even a small amount of such a complex e.g. of about 0.1 mmol/l is beneficial. The conversion coating solution accelerator additives selected from compounds of metals of the group of Cu, Ag, Au, Cd, Hg, Ni, Pd, Pt, Co, Rh, Ir, Ru, Os, Sn, Pb, Sb, Bi, Se and Te can enhance the coating adhesion to and/or rate of coating on the metallic surface. It is particularly preferred to have a small excess of a complexing agent over the compounds and complexes of the accelerator additive. If compounds with elements selected from the group of elements of Ag, Sn, Pb, Sb, Bi, Se and Te are used, solution stability dictates no upper limit of the content of this compound as in most cases there should be no catalytic decomposition of hydrogen peroxide to water which might increase with the content of this compound.

It is preferred not to add the complexing agent and any compound containing the accelerator additive separately, but to add at least one complex species containing the accelerator additive formed previously as mentioned above, because the formation of complex(es) containing that additive/s may be difficult to achieve in dilute solution.

It is desirable not to have significant contents of Fe in the conversion coating solution. The presence of this element may cause a higher and more expensive consumption of the peroxidic compound(s), as it can influence the peroxide stability in the solution, requiring replenishment of the peroxidic compound(s). Iron may accumulate in the solution as a result of being dissolved from the surface of the metallic material. Therefore, it is preferred to avoid the intentional addition of significant amounts of Fe.

Nevertheless, the process of the invention can still be practiced using conversion coating solutions which are practically stable or to an acceptable degree unstable with regard to the decomposition of the peroxidic compound(s). Therefore, this process may be successfully used for Fe containing alloys which release Fe into solution at a concentration of up to e.g. 1 to 5 mg/l. In this case, the loss of peroxidic compound may be in the range of about 0.1 to about 5% by weight per day.

In one preferred embodiment, the conversion coating solution contains from 0.5 to 800 g/l of at least one REE, 1 to 120 g/l of any peroxidic compound and 1 to 500 mg/l of at least one accelerator additive, preferably selected from the group of metals of Cu, Ag, Au, Cd, Hg, Ni, Pd, Pt, Co, Rh, Ir, Ru, Os, Sn, Pb, Sb, Bi, Se and Te. More preferably, the conversion coating solution contains from 1 to 40 g/l of at least one REE, 2 to 35 g/l of any peroxidic compound and 2 to 160 mg/l of at least one accelerator additive, especially selected from the group of elements Cu, Ag, Sn, Pb, Sb, Bi, Se and Te. A mixture of rare earth elements with a cerium content, hydrogen peroxide and/or copper is especially beneficial.

In another preferred embodiment, the conversion coating solution contains of from 0.03 to 0.3 mol/l of at least one REE, 0.05 to 1.2 mol/l of any peroxidic compound and 0.01 to 1.0 mmol/l of at least one accelerator additive, especially a metal selected from the group of Cu, Ag, Au, Cd, Hg, Ni, Pd, Pt, Co, Rh, Ir, Ru, Os, Sn, Pb, Sb, Bi, Se and Te. More preferably, the solution contains a mixture of rare earth elements with a cerium content, hydrogen peroxide and/or copper.

The pH value of the conversion coating solution may be adjusted to a value of from 1 to 2.9. The solution may have a pH value of from 1.7 to 2.5, preferably of from 1.9 to 2.2. It is generally not sufficient to generate the acidic state only by the dissolution of a cerium salt, e.g. cerium chloride. Instead it is typically necessary to add an acid or acid mixture and adjust the pH value with this acid or acid mixture. If the coating solution contains e.g. $Ce^{3+}$ and hydrogen peroxide, it is desirable to keep the solution at a pH value of about 2 in order to have a stable conversion coating solution. If the pH value is much above 2.3, REE compounds may oxidize and precipitate in the bath. If the pH value is much below 1.7, the formation of the conversion coating is slowed down or prevented.

Before starting-up a fresh bath solution or after having processed a number of parts, the pH value of the solution may be adjusted by at least one acid selected from the group of mineral acids, carboxylic acids, sulphonic acids and phosphonic acids. Preferably the acid is selected from the group of hydrochloric acid, nitric acid, perchloric acid, sulphuric acid, methanesulphonic acid and sulphamic acid. The acid should preferably not be hydrofluoric or phosphoric and because of the restriction on fluoride and phosphate concentration in solution. If the metal is aluminum or an aluminum alloy, the sulfur-containing acids are preferred. It is especially preferred to adjust the pH with a mixture of at least two acids, one of which is a sulfur containing acid and the other is hydrochloric acid. If the metal is zinc, a zinc alloy, magnesium or a magnesium alloy, it is preferred that the acid used for adjusting the pH value of the bath solution contains nitric acid.

The conversion coating solution contains substantially no chromate, that means, that there is no intentional addition of chromate or a chromium compound that may cause formation of $Cr^{6+}$ ions in solution. Normally, this means a chromate content of not more than 1 mg/l.

The conversion coating solution should contain minimum or no fluoride and/or phosphate content. The content of these anions is limited by the very low solubility limits of their cerium salts. Both $CePO_4$ and $CeF_3$ are highly insoluble. Accordingly, any concentration of fluoride or phosphate species above a very low level results in formation of a "sludge" of the cerium salts in solution, thereby reducing the concentration of soluble cerium. Nevertheless, at least a small content of fluoride and/or phosphate usually does not affect the process of the invention. Therefore, the solution may be essentially free of fluoride and/or phosphate added to the solution as there has not been any intentional addition of these anions. In many cases, the fluoride and/or the phosphate content will therefore be less than 20 mg/l.

If the metallic surface is of aluminum or of an aluminum alloy, the content of chloride in the conversion coating solution needs to be at least 30 mg/l, such as at least 50 mg/l, preferably at least 100 mg/l of chloride, particularly preferred at least 200 mg/l. The chloride content may be at least 320, 380, 450 or 550 mg/l. A chloride content in a range of from 150 to 1600 mg/l may be used, preferably of from 420 to 1200 mg/l, particularly preferred from 520 to 820 mg/l. A minimum chloride content is generally needed, particularly for coating of Al or Al alloy, otherwise the formation of the conversion coating would be too slow or even totally prevented. However, stainless steel will be affected by solutions with a chloride content of more than 2 g/l. On the other hand, it may be quite sufficient to use the process of the invention with a chloride content of e.g. 400 mg/l which means that there is a corrosion rate of the stainless steel containers holding the conversion coating solution which is nearly zero. The corrosion rate for stainless steel increases with the chloride content of the solution in contact with the stainless steel. Therefore, it is preferred to work with a solution of a chloride content in the range of 150 to 800 mg/l. Nevertheless, it was astonishing that a chloride content of up to 2 g/l did not considerably affect stainless steel.

The present inventors have discovered that in using the process of WO 96/15292 there has to be an increase of the chloride content during the treatment of metallic surfaces e.g. of an aluminum alloy starting from e.g. 3.5 g/l chloride continuously to higher chloride contents the more aluminum alloy surfaces have been treated. This relatively high chloride content can cause a significant corrosion of stainless steel containers.

The inventors have found that, contrary to the process of WO 96/15292 the process according to the present invention does not need a relatively high content of chloride and furthermore does not necessarily need an increase in the chloride content for the ongoing treatment of surfaces e.g. of an aluminum alloy. Therefore, one may keep the chloride content of solution at about the same low level for the duration of the process. In this manner, there does not occur any local corrosion attack on the surfaces of the walls of the stainless steel containers which might be used for tanks or other equipment.

If the metallic surface being coated is of magnesium, zinc or one of their alloys, the process does not require an upper limit for the nitrate content in the coating solution. If the metallic surface is, however, of aluminum or one of its alloys, the nitrate concentration in the treatment solution should preferably not exceed 500 mg/l, more preferably 300 mg/l, more preferably 200 mg/l, particularly preferred 50 mg/l.

The conversion coating solution may additionally contain a surfactant, a biocide, a stabilizer for the peroxidic compound and/or at least one of the metals which are contained in the surface layer of the metallic part. Of course, there may be added other agents such as a foaming or an antifoaming agent.

The surfactant should be preferably in an amount effective to lower the surface tension of the solution and to facilitate the wetting of the metallic surface. The inclusion of a surfactant is beneficial in that by reducing surface tension of the solution, it thereby minimizes "drag-out" from the solution. "Drag-out" is an excess portion of coating solution which adheres to the metal and is removed from the solution with the metallic material and subsequently lost. Accordingly, there is less waste and costs are minimized by adding surfactant to the solution. A surfactant may also help to reduce cracking in the coating. The surfactant may be present in the solution at a concentration up to 0.1%, such as 0.01%.

The conversion coating solution may additionally contain stabilizers for hydrogen peroxide or any other peroxidic compound. Such stabilizers may enter the coating solution via the stabilizer content in the commercially available peroxide, or such stabilizers may be added intentionally to the coating solution. Compounds described in the literature as stabilizers for hydrogen peroxide include propionic acid, dipropylene glycol, ammonium nitrate, sodium stannate, sodium pyrophosphate, and phosphoric acid. In some cases, such as phosphoric acid or sodium pyrophosphate, the levels of soluble stabilizer achievable in the coating solution will be severely limited by the solubility of the respective cerium salts.

At least one of the cations of the chemical elements in the conversion coating solution may be introduced into solution by dissolution of the corresponding metal present in the surface layer of the metal being coated. It may be advantageous to add an additional amount of these cations to the solution to a certain amount to shorten the period of time required for the solution to reach a steady-state working condition.

The conversion coating solution is used at a solution temperature below the boiling temperature of the solution. The solution temperature is typically below 100° C., such as below 75° C. Preferably, the upper temperature limit is 60° C., such as up to 55° C. In some embodiments, the preferred upper temperature limit is 50° C. The lower temperature limit of the solution may be at about 0° C., although it is preferably in the range of 18° C. up to 45° C. More preferably, the solution temperature is not less than 35° C. If the temperature of the solution is higher, especially above 75° C., a boehmite coating may be formed on aluminum containing metallic surfaces which is not necessary for this invention, but which on the other hand does not affect it. Preferably, there is essentially no precipitation of boehmite upon the surface of the metallic part. Increasing temperature will also increase the decomposition of the peroxidic compound. With $H_2O_2$ at temperatures above 65° C., the decomposition is very fast.

Relatively higher concentration solutions are required when using short treatment times, such as in coil coating processes. The coated coil may be additionally treated either before or after the conversion coating step, with another corrosion inhibiting substance, such as with a passivation pretreatment, or with a primer or a paint.

The conversion coating may be applied by any known process for reacting the metallic surface with the aqueous coating solution. Typical methods of contacting a metallic substrate with a solution are immersing (=dipping), spraying, roll-coating or swabbing. In the case of coating a metallic coil, the solution may also be dried on or "squeegeed", such as by using a roll-coater.

The conversion coating formed shows a good adhesion to the metal and provides good corrosion protection. It may be preferred to apply a sealing (final rinse) onto the conversion coating, and/or if wanted a paint film. The conversion coating is an excellent paint base, providing adhesion of the paint film to the metal and safeguarding and enhancing the corrosion protection of the paint film.

The weight of the conversion coating depends primarily on the thickness and structure of the coating as well as of the densities of the compounds and chemical elements precipitated. The thickness itself depends for example, on the duration of treatment. If the coating is too thin, it may result in the main element of the metallic surface being precipitated in a relatively high amount, such as aluminum as a hydroxide or oxide upon a surface of aluminum or an aluminum alloy. This precipitation may affect the properties of the conversion coating. On the other hand, if the coating is too thick, there may be a decrease of the adherence of the coating on the surface of the metallic part.

The coating weight may range from 0.01 to 100 g/m$^2$, preferably from 0.05 to 5 g/m$^2$. If intended as a paint base, the especially preferred coating weight is from 0.1 to 3 g/m$^2$; if no further paint film is applied, the especially preferred coating weight is of from 0.4 to 10 g/m$^2$.

The density of the coatings is unknown, however, It is estimated to be in the range of 2 to 5 g/cm$^3$. Assuming a value of 3 g/cm$^3$, the corresponding coating thickness would range preferably from 3 nm to 33 $\mu$m, particularly preferred from 17 nm to 1.7 $\mu$m and especially preferred from 0.033 to 1.0 $\mu$m, when intended as a paint base; or particularly preferred from 0.13 to 3.33 $\mu$m, if no paint film is to be applied thereon.

The coating weight is determined by stripping the coating in a suitable stripping solution and taking the weight difference before and after the removal. A suitable stripping solution for aluminum and its alloys is e.g. a 15% nitric acid solution in water.

The determination of the coating thickness usually is more complicated: Methods which rely on a probe touching the surface will be compromised by the indentation that the probe invariably makes; producing a good cross cut for a microscopic measurement is very cumbersome. Below 50 mg/m$^2$ of coating weight, the preferred method for determining 'coating weight' is by X-ray fluorescence for the REE, or a microprobe, as the weigh-strip-weigh-method becomes increasingly less accurate.

The mean particle size of the grains or crystals of the formed conversion coating may be in the range of up to 5 $\mu$m just after formation, preferably in the range of from 0.1 to 1.5 $\mu$m. The mean particle size may be measured on photographs taken with a scanning electron microscope from the surface of the conversion coating. In many cases, the coating shows a more gel-like morphology so that no crystals can be identified just after formation.

It is preferred that the coating appears dense and homogeneous when judged by the eyes or with a low (e.g. tenfold) magnification. In the coating there may be embedded crystals of less than 5 $\mu$m of an element and/or a compound containing a chemical element of the group selected from Cu, Ag, Au, Cd, Hg, Ni, Pd, Pt, Co, Rh, Ir, Ru, Os, Sn, Pb, Sb, Bi, Se and Te. These elements or their compounds may contribute to up 100 mg/m$^2$ to the coating weight, often to not more than 30 mg/m$^2$.

The content of REE compounds in the coating may vary in broad ranges e.g. in the range of from 5 to 99.9% by weight. Nevertheless, it is preferred to have a content of REE in the range of from 20 to 92% by weight, particularly preferred in the range of from 50 to 88% by weight, especially preferred in the range of from 60 to 85% by weight. Furthermore, the content of cerium in the total REE may vary in broad ranges, too. Nevertheless, it is preferred to have an amount of a cerium containing compound in the range of from 3 to 99.9% by weight, particularly preferred in the range of from 30 to 99.8% by weight. In many cases, the content of the cerium containing compound may vary of from 60 to 99% by weight.

The formed conversion coating is preferably coloured to distinguish a treated from an untreated surface, unless the conversion coating is too thin. The colour is preferably yellowish, yellow, or orange, as this is the well-accepted colour of chromate coatings. The conversion coatings may be so thin that the metallic luster of the metal, its grain structure, and/or the structure resulting from the e. g. rolling process can be seen through the coating. In any case, the colour of the coating may be a helpful characteristic to control the quality of the coating, unless the coating is colourless. The colour may be caused by a high content of $Ce^{4+}$. On the other hand, certain amounts of other coloured REE ions may be chosen to generate a coloured conversion coating. Such REE chosen for the conversion coating may be Pr Nd, Sm, Eu, Tb, Dy, Ho, Er or Tm and/or their mixtures.

After the formation of the conversion coating on the metallic substrate, a lubricant, a sealant and/or a paint may be applied onto the conversion coating. There may be applied combinations of a sealant and a lubricant or of a sealant and a paint. These process steps are generally well-known. If a sealant step is used, preferably the coated metallic surface is rinsed prior to and sometimes also after the sealing process. The conversion coating may be sealed by treatment with at least one of a variety of aqueous or non-aqueous inorganic, organic or mixed sealing solutions. The sealing solution may contain alkali silicates, borates, $Cr^{3+}$-containing salts, Al and Zr fluorides, phosphates, silanes, polyacrylates and/or their derivatives, polyvinylphenole derivatives and/or other polymers. The sealing solution forms a surface layer on the conversion coating and may further enhance the corrosion resistance of the conversion coating. A similar effect may be gained with a painting step.

The metallic material of construction of the surface-treated part may primarily be another or the same material as the material at the surface. The metallic material may be e.g. steel carrying a coating of zinc or a zinc alloy. On the other hand, the metallic material of construction of the surface treated part may be e.g. an aluminum alloy of the series 6000 which does not carry any metallic coating so that its surface is of this alloy. Preferably, the metallic material at the surface is aluminum or an aluminum alloy, preferably an aluminum alloy of the series 3000, 5000 or 6000. Its conversion coating may contain at least 5% by weight of REE and may contain at least traces of at least one metal selected from Groups IB, IIB, IVA, VA, VIA and VIII of the Periodic Table, preferably from the group of elements of Cu, Ag, Au, Cd, Hg, Ni, Pd, Pt, Co, Rh, Ir, Ru, Os, Sn, Pb, Sb, Bi, Se and Te, more preferably of copper or a compound of copper.

The liquid acidic aqueous concentrate for the make-up of a conversion coating solution for forming a conversion coating on the surface of the metallic material contains preferably at least 100 g/l of total REE, particularly preferred at least 125 g/l. It may contain at least one metal selected from Groups IB, IIB, IVA, VA, VIA and VIII, preferably from the group of Cu, Ag, Au, Cd, Hg, Ni, Pd, Pt, Co, Rh, Ir, Ru, Os, Sn, Pb, Sb, Bi, Se and Te, more preferably from the group of elements Cu, Ag, Sn, Pb, Sb, Bi, Se and Te, most preferably Cu. Preferably, at least one of the REE containing compounds is a cerium compound.

The preferred concentrate contains at least one of the acids of the group of nitric acid, perchloric acid, sulphuric acid, methanesulphonic acid and sulphamic acid. If the metal is aluminum or an aluminum alloy, the chloride content is preferably of more than 500 mg/l. The conversion coating solution may be typically produced by mixing a concentrate for the make-up of a conversion coating solution with water and at least one peroxidic compound. The solution may be diluted preferably by a factor of from 5:1 to 25:1 of water concentrate, particularly preferred in the range of from 8:1 to 15:1.

The water used for the concentrates as well as in the process should preferably be of high purity. De-ionized water is especially preferred. However, tap water, unless of high hardness, may often be acceptable as well.

Preferably the coating solution is produced by using as peroxidic compound a solution of hydrogen peroxide, usually stabilized. The preferred concentration is approximately 35% by weight, which is commercially available, or 19% by weight, which considerably reduces the risk during handling. Although concentrations of 50% by weight and higher are commercially available, such concentrations must not be used, as there is an increasing risk of explosive decomposition of the hydrogen peroxide, especially when coming into contact with contaminants.

The liquid acidic aqueous concentrate for the replenishing of a conversion coating solution for forming a conversion coating on the surface of the metallic material may contain REE ions and monovalent anions in a molar ratio of total REE ions:monovalent anions of from 1 200 to 1:6.

The liquid acidic aqueous concentrate for the replenishing of a conversion coating solution for forming a conversion coating on the surface of a metallic material may contain REE ions and divalent anions in a molar ratio of total REE ions:divalent anions of from 1:100 to 1:3.

The liquid acidic aqueous concentrate for the replenishing of a conversion coating solution for forming a conversion coating on the surface of a metallic material may contain at least one metal selected from Groups IB, IIB, IVA, VA, VIA and VIII, preferably from the group of Cu, Ag, Au, Cd, Hg, Ni, Pd, Pt, Co, Rh, Ir, Ru, Os, Sn, Pb, Sb, Bi, Se and Te and anions such that the molar ratio of the sum of the elements in this group:anions is in the range from 1:50 to 1:10,000.

The conversion coating solution can be used for treating a large number of parts—in fact the ratio of surface area treated and bath volume may well exceed 2 $m^2/l$, if all substances whose concentration have decreased by the conversion coating process are replenished. Such a decrease may result from forming the conversion coating itself, from dissolving part of the metal surface, from precipitation in the bath, from intentionally or unintentionally overflowing the conversion coating solution, from decomposition or from drag-out. It is preferred to replenish the coating solution using the concentrate for replenishing and an additional solution containing a peroxidic compound, preferably one of the preferred hydrogen peroxide solutions described above. Of course, water lost due to evaporation must also be replenished.

The aqueous, acidic solution for forming a conversion coating on the surface of a metallic material—preferably of the group of aluminum, aluminum alloy, magnesium, magnesium alloy, zinc and zinc alloy—may contain ions and/or complex species of the at least one metal selected from Groups IB, IIB, IVA, VA, VIA and VIII, particularly of metals of the group Cu, Ag, Sn, Pb, Sb, Bi, Se and Te. It may contain ions and/or complex species of a mixture of rare earth elements, whereby the ratio of cerium to total rare earth elements is at least 5% by weight. Furthermore, the solution may contain ions and/or complex species of copper.

In a preferred embodiment, the aqueous, acidic solution contains sulphate and/or sulphamate, cerium, a peroxidic compound and from 50 mg/l of chloride, whereas a content of copper added to the conversion coating solution is desired. This solution may contain cerium and hydrogen peroxide. There may be an additional content of nitrate, especially if the metallic material is not of aluminum or of an aluminum alloy.

EXAMPLES

The following examples illustrate, in detail, embodiments of the invention. The following examples shall help to clarify the invention, but they are not intended to restrict its scope:

Substrates

1. Magnesium alloy AZ91, sized 100*100*4 mm,
2. Aluminum magnesium alloy AA 5005, cold rolled, sized 100*100*0.7 mm,
3. Aluminum silicon magnesium alloy AA 6063, flat extruded profile, sized 100*80*3.5 mm,
4. Hot dip galvanized steel, cold rolled steel, 15 $\mu$m zinc layer, minimal spangle, sized 105*190*0.7 mm.

Process

The parts were conversion coated using a standard process sequence for pre-treatment and after-treatment. The process is typical in the field. The cleaning is done with an aqueous, non-etching, silicate-free alkaline cleaner, Gardoclean® T 5374 of Chemetall GmbH; the pH of the bath solution was 10 after make-up. As a deoxidizer for these alloys which contain small amounts of copper only, a hydrofluoric/phosphoric acid mixture, Gardacid® AL of Chemetall GmbH was used at a total concentration of 1.25 mol/l of free acid. The coating was done by immersing, unless otherwise noted. Gardacid®, Gardobond®, and Gardoclean® are registered trademarks of Chemetall GmbH, Frankfurt am Main, Germany.

TABLE I

Process Sequence

| Step | Process | Chemicals, Equipment | Concentration [g/l] | Temperature [° C.] | Time [sec] |
|---|---|---|---|---|---|
| 1 | Alkaline cleaning | Gardoclean ® T 5374 | 40 | 60 | 300 |
| 2 | Rinsing | Water | | Ambient | 30 |
| 3 | Deoxidizing (for aluminum alloys only) | Gardacid ® AL | 57 Gardacid AL5<br>22 Gardacid AL6 | Ambient | 180 |
| 4 | Rinsing (for aluminum alloys only) | Water | | Ambient | 30 |
| 5 | Rinsing | De-ionized water | | Ambient | 30 |
| 6 | Conversion Coating | See specific examples | | 45 | 150 |
| 7 | Rinsing | Water | | Ambient | 30 |
| 8 | Final Rinsing | De-ionized water | | Ambient | 30 |
| 9 | Drying | Oven | | 80 | 600 |

Solutions

Comparative Example A: Chromate-Based Conversion Coating

The conversion coating solution was prepared by dissolving 31 g/l of Gardobond® C 720 and 0.9 g/l $K_3[Fe(CN)_6]$ in de-ionized water. This corresponds to to a chromic acid concentration of 4.5 g/l.

Comparative Example B: Non-Accelerated Cerium-Based Conversion Coating

A conversion coating solution as disclosed by Wilson, et al. in WO 88/06639 was prepared by dissolving the following in de-ionized water:

15 g/l $CeCl_3.7H_2O$, corresponding to 5.6 g/l $Ce^{+++}$, 25 g/l $H_2O_2$ and hydrochloric acid to adjust pH to 2.2.

Comparative Example C: Accelerated Cerium-Based Conversion Coating

A conversion coating solution as disclosed by Hughes, et al. in WO 96/15292 was prepared by dissolving the folloing in de-ionized water:

13.2 g/l $CeCl_3.7H_2O$, corresponding to 5 g/l $Ce^{+++}$, 3.0 g/l $H_2O_2$, 60.0 mg/l $Cu^{++}$, added as $CuCl_2.2H_2O$, 0.1 g/l titanium as Ti-peroxo-complex, prepared by reacting $TiCl_4$ in 35% $H_2O_2$ solution, and hydrochloric acid to adjust pH to 2.0.

Examples According to the Invention

The pH value of all solutions was 2.0–2.1. The compositions of the solutions are given in Table II. The pH value was adjusted using the acid corresponding to Anion 1. No other anions were introduced into the solution besides Anion 1 and chloride.

Cerium salts were prepared by dissolving cerium carbonate in the appropriate acids, Accordingly, cerium (III) chloride, cerium (III) sulphate, cerium (III) sulphamate, cerium (III) nitrate, cerium (III) perchlorate and cerium (III) methanesulphonate, were formed by dissolving cerium carbonate in hydrochloric acid, sulphuric acid, sulphamic acid, nitric acid, perchloric acid and methanesulphonic acid, respectively.

In order to form the accelerator additive, bismuth-(III)-oxide or copper-(II)-carbonate were dissolved in the appropriate acids in the presence of the complexant—whenever present—, and the necessary quantity of the accelerator was added to the conversion coating solution.

TABLE II

Conversion coating solutions according to the invention

| # | Cer | $H_2O_2$ | Acceleator | | Complexant | | Anion 1 | | Chloride | |
|---|---|---|---|---|---|---|---|---|---|---|
| Example | [mmol/l] | [mmol/l] | Type | [mmol/l] | Type | [mmol/l] | Type | [mmol/l] | [mmol/l] | Metal |
| 1 | 100 | 500 | $Cu^{++}$ | 0, 4 | None | n.a. | Sulphamate | 312 | 5 | Al |
| 2 | 100 | 500 | $Cu^{++}$ | 0, 4 | None | n.a. | Sulphamate | 312 | 20 | Al |
| 3 | 150 | 800 | $Bi^{+++}$ | 0, 15 | HEDTA | 0, 2 | Sulphamate | 463 | 8, 5 | Al |
| 4 | 100 | 600 | $Cu^{++}$ | 0, 5 | None | n.a. | Sulphate | 160 | 40 | Al |
| 5 | 50 | 500 | $Cu^{++}$ | 0, 5 | Glycine | 1, 1 | Methane-Sulphonate | 164 | 25 | Al |

TABLE II-continued

| # | Cer | $H_2O_2$ | Acceleator | | Complexant | | Anion 1 | | Chloride | |
|---|---|---|---|---|---|---|---|---|---|---|
| Example | [mmol/l] | [mmol/l] | Type | [mmol/l] | Type | [mmol/l] | Type | [mmol/l] | [mmol/l] | Metal |
| 6 | 100 | 200 | $Cu^{++}$ | 0, 8 | None | n.a. | Sulphamate | 315 | 5 | Zn; Mg |
| 7 | 100 | 300 | $Cu^{++}$ | 0, 8 | None | n.a. | Nitrate | 315 | 2 | Zn; Mg |

Results

The test specimens were treated according to the process specified in Table I using the solutions A, B, and C for the comparative examples and the solutions 1 through 7 (Table II) for the Examples 1 to 7, respectively, according to the invention. The coating was judged for colour, for complete coverage, for optical uniformity, and for localized attack of the metallic surface. The coating weight was determined by the weight difference before and after stripping the coating with 15% nitric acid. Some coatings were also analyzed for the cerium content by X-ray fluorescence analysis using samples for the calibration of the same alloys with a known cerium content on the surface.

A number of parts were painted with a polyester powder paint such as is commonly used for outdoor architectural profiles. The painted parts were subjected to adhesion testing by Cross Hatch according to DIN ISO 2409 and to accelerated corrosion testing in the Salt Spray Test ESS DIN 50 021 (Acetic Acid Enhanced) and CASS DIN 50 021 (Copper-Acetic Acid enhanced).

Solution and Coating Quality

Comparative Example A:

The substrates 2 and 3 (AA 5005 and AA 6063) were treated. Within 90 sec a visible coating appeared during immersion of the parts in the chromating solution. After the specified time the coating was uniform, completely covering the surface and the edges of the part, and bright yellow. The coating weight was 540 and 620 mg/m$^2$ for the AA 5005 and AA 6063 parts, respectively.

Comparative Example B:

The substrates 2 and 3 (AA 5005 and AA 6063) were treated. No coating was formed on either alloy. Changing conditions of cleaning, deoxidation, and of immersion time as well as of temperature in the conversion coating step did not produce any visible coating, although some reaction was indicated by the effervescence of the solutions during the immersion of the parts. The treatment time was well explored beyond any reasonable length for an industrial setting, yet even 30 min did not provide an acceptable result. The decomposition of peroxide was below 2% in 24 h while standing at 45° C.

Comparative Example C:

The substrates 2 and 3 (AA 5005 and AA 6063) were treated. A yellow coating developed on the parts with a coating weight of 340 and 450 mg/m$^2$ on AA 5005 and AA 6063, respectively. The coating was yellow and slightly non-uniform. There was some tendency towards streaking. The coverage was complete. The decomposition of peroxide was 25% in 24 h while standing at 45° C.

Example 1

The substrates 2 and 3 (M 5005 and AA 6063) were treated. A yellow coating formed on most of the aluminum surface, but the coating appeared very non-uniform and full of streaks; some areas did not show any yellowish colour. The decomposition of peroxide was 12% in 24 h while standing at 45° C.

Example 2

The substrates 2 and 3 (AA 5005 and AA 6063) were treated. A uniform, yellow coating with a darker tint developed on both alloys; the coating weight was 460 and 590 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 45 and 53% by weight, respectively. The decomposition of peroxide was 11% in 24 h while standing at 45° C.

Example 3

The substrates 2 and 3 (AA 5005 and AA 6063) were treated. A uniform, light yellow coating developed on both alloys; the coating weight was 240 and 190 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 25 and 35% by weight, respectively. No precipitate formed in the bath solution after standing at 45° C. for 24 h. The decomposition of peroxide was below 2% in 24 h while standing at 45° C.

Example 4

The substrates 2 and 3 (AA 5005 and AA 6063) were treated. A slightly non-uniform, yellow coating developed on both alloys; the coating weight was 715 and 630 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 72 and 63% by weight, respectively. The decomposition of peroxide was 14% in 24 h while standing at 45° C.

Example 5

The substrates 2 and 3 (AA 5005 and AA 6063) were treated. A uniform dark yellow coating developed on both alloys; the coating weight was 950 and 1050 mg/m$^2$ for AA 5005 and AA 6063, respectively. The adhesion of the conversion coating was tested with an adhesive tape: After pulling off, a fine powder adhered to the tape as could be seen after the tape was put onto white paper, while the coating after the test still looked intact. The cerium content of the coating was 75 and 83% by weight, respectively. The decomposition of peroxide was below 5% in 24 h while standing at 45° C.

Example 6

The substrates 1 and 4 (AZ 91 and hot dip galvanized steel (hdg)) were treated. On both kinds of substrates, a uniform, shiny yellow coating developed. No localized attack could be discerned. The coating weight was 530 and 710 mg/m$^2$ for AZ 91 and hdg, respectively. The adhesion of the conversion coating was tested with an adhesive tape: After pulling off, only very slight traces could be seen after the tape was put onto white paper. The decomposition of peroxide was below 12% in 24 h while standing at 45° C.

Example 7

The substrates 1 and 4 (AZ 91 and hot dip galvanized steel [hdg]) were treated. On both kinds of substrates, a uniform, shiny yellow coating developed. No localized attack could be discerned. The coating weight was 600 and 820 mg/m$^2$ for AZ 91 and hdg, respectively. The adhesion of the conversion coating was tested with an adhesive tape: After pulling off, only very slight traces could be seen after the tape was put onto white paper. The decomposition of peroxide was below 18% in 24 h while standing at 45° C.

Corrosion Tests on Stainless Steels

The ASTM G48-92 "Standard Test Methods for Pitting and Crevice Corrosion Resistance of Stainless Steels and Related Alloys by Use of Ferric Chloride Solution" was used to assess the corrosiveness of the solutions according to the Comparative Examples (A) through (C) and the Examples according to this invention (1) through (7). The test specifications were adapted in that the ferric chloride solution specified in the Standard as corrosive liquid was replaced by solutions (A) through (C) and (1) through (7). The stainless steel specimens were of the 314 type. The tests were run at 45° C. for 72 hours; weight changes were then calculated to give mm per years weight loss or weight increase. Specimen size was 2.5×5 cm. Results are collected in Table IV. For comparison example C, the weight loss may well be due to the pitting or crevice corrosion.

TABLE IV

Attack on stainless steel type 314

| Solution | | [mm/a] | Number of Pits |
|---|---|---|---|
| A | Comparison | okay | 0 |
| B | Comparison | 0.04 | 18 |
| C | Comparison | 0.03 | 7 |
| 1 | Invention | <0.001 | 0 |
| 2 | Invention | <0.001 | 0 |
| 3 | Invention | <0.001 | 0 |
| 4 | Invention | <0.001 | 0 |
| 5 | Invention | <0.001 | 0 |
| 6 | Invention | <0.001 | 0 |
| 7 | Invention | <0.001 | 0 |

Similar results occurred for stainless steel type 304 specimens. None of the solutions according to the invention produced any pitting of the stainless steel specimens in the test, and the weight loss was smaller than 1 mg per specimen; in fact, a few samples showed a small weight gain of a few milligrams due to the deposition of a very thin film. Extrapolating these numbers assuming growth constant in time and a density of 7.9 g/cm$^3$, a film of a thickness of from 0.3 to 4 $\mu$m per year would result.

Paint Results

Two specimens each of the AA 6063 alloy underwent testing after painting. Two specimens of AZ 91 of Example 7 were also painted. The results are collected in Table III.

TABLE III

Results from Paint Testing

| Example | Cross Hatch | ESS 1000 h | ESS 2000 h | CASS 1000 h |
|---|---|---|---|---|
| A Comparative | 0 | <1 mm | <1 mm | <1 mm |
| B Comparative | 1–2 | 1 mm | 4 mm | 5 mm |
| C Comparative | 0 | <1 mm | 1 mm | 1 mm |
| 1 Invention | 0 | <1 mm | 1 mm | 1.5 mm |
| 3 Invention | 0 | <1 mm | 1.5 mm | 1.5 mm |
| 4 Invention | 0 | <1 mm | 1 mm | 1 mm |
| 5 Invention | 0–1 | <1 mm | 1 mm | not done |
| 7 Invention | 0 | not done | not done | not done |

The rating for the Cross Hatch Test is from
0: 'No cracking and delamination of the paint along the cuts' to
4: 'Complete removal of the paint'.

The creepage for the ESS Test is from the scribe to one side.

The results of the corrosion and adhesion tests show that the quality standards set by chromating aluminum are also met by the treatment according to the invention, which will allow the replacement of the carcinogenic, toxic chemicals by products which are not more than corrosive.

Concentrates

Example 8

1. A liquid make-up concentrate was made by the following method:

415 g cerium carbonate with 50% cerium(III) calculated as $CeO_2$ and a ratio of $CeO_2$ to Total Rare Earth Oxides of >95% was dissolved in a mixture of 26.4 g of 35% hydrochloric acid, 164 g 96% sulfuric acid and 400 g of de-ionized water. A slightly turbid solution resulted, which was filtered and then 1.5 g of copper-(II)-sulphate-5-hydrate were added. A light blue clear solution resulted which was stable for at least 2 months when stored at 50° C.

Example 9

2. A liquid concentrate for replenishing was made by the following method:

179 g cerium carbonate with 50% cerium(III) calculated as $CeO_2$ and a ratio of $CeO_2$ to Total Rare Earth Oxides of >95% was dissolved in a mixture of 3.1 g of 35% hydrochloric acid, 542 g 96% sulfuric acid and 275 9 of de-ionized water. A slightly turbid solution resulted, which was filtered, and then 4.7 g of copper-(II)-sulfate-5-hydrate were added. A light blue clear solution resulted which was stable for at least 2 months when stored at 50° C.

Throughput

Example 10

A processing line was set up in the laboratory consisting of glass beakers with 2 liters of bath solution each according to the processing steps of Table I. The conversion coating solution was prepared by adding 240 g of this make-up solution to de-ionized water. This solution contained

| | |
|---|---|
| Ce | 14.1 g/l |
| Cu | 32 mg/l |
| Cl | 750 mg/l |

at a pH value of 1.98. Then 20 g/l of hydrogen peroxide were added. A large number of panels of AA 6063 with a total surface area of 2 $m^2$ were processed by immersing through the line on two consecutive days, using treatment times and temperatures as given in Table I. The solutions were allowed to cool overnight. Before resuming work and after having treated 5 of the panels, the pH value was regularly measured, and the peroxide concentration was determined by titration with potassium permanganate solution. The replenishing solution of Example 9, was added to adjust the pH value to the range between 1.95 and 2.05, and a solution of 35% by weight of $H_2O_2$ was added to keep the concentration of $H_2O_2$ in the range of from 17 to 21 g/l.

Uniform, yellow coatings were formed. The coating weights varied from initially 1200 mg/$m^2$ to about 800 mg/$m^2$ at the end of the throughput, the latter value was still considered as being good. The peroxide decomposition was about 12% in the first night (about 16 hours) and about 14% in the second night. The final solution was analysed. It had a pH value of 2.0

| | |
|---|---|
| Ce | 13.7 g/l |
| Cl | 0.80 g/l |
| $Al^{+++}$ | 1.2 g/l |
| $Cu^{++}$ | 40.0 mg/l |
| $Fe^{+++}$ | 1.5 mg/l |
| $H_2O_2$ | 18.7 g/l |

Finally, it is to be understood that various alterations, modifications and/or additions may be introduced into the constructions and arrangements of parts previously described without departing from the spirit or ambit of the invention.

What is claimed is:

1. An aqueous acidic solution for forming a conversion coating on the surface of a metallic material, said solution containing at least one rare earth element containing species, an accelerator additive selected from the group consisting of Cu, Ag, Sn, Pb, Sb, Bi, Se and Te, a peroxidic species and at least one acid selected from the group consisting of mineral acids, carboxylic acids, sulphonic acids and phosphonic acids, and a total chloride concentration within the range of from 30 to 1500 mg/litre, wherein said solution contains no more than 20 mg/litre each of fluoride and of phosphate, and the solution is substantially free of chromate.

2. The solution of claim 1, wherein said total chloride concentration is from 50 to 1500 mg/litre.

3. The solution of claim 1, wherein the solution contains only one accelerator additive.

4. The solution of claim 1, wherein the accelerator additive is Cu, preferably at a concentration from 0.01 to 5 mmol/litre.

5. The solution of claim 1, wherein the at least one acid is selected from the group consisting of sulphuric acid, sulphamic acid, hydrochloric acid, nitric acid, perchloric acid, carboxylic acids, alkyl sulphonic acids, aryl sulphonic acids, alkyl phosphonic acids and aryl phosphonic acids.

6. The solution of claim 1, wherein said at least one rare earth element containing species comprises ions and/or complex species of a mixture of REE wherein the ratio of cerium to total REE is at least 5% by weight, preferably at least 30% by weight, more preferably at least 60% by weight.

7. The solution of claim 1, wherein the concentration of rare earth element containing species is in the range of 0.5 to 1000 g/l, preferably from 1 to 60 g/l, more preferably from 2 to 30 g/l.

8. The solution of claim 1, wherein the rare earth elements are introduced into the coating solution in the form of a soluble salt selected from the group consisting of cerium (III) containing chloride, cerium (III) containing sulphate, cerium (III) containing sulphamate, cerium (III) containing nitrate, cerium (III) containing perchlorate and cerium (III) containing methanesulphonate, preferably said soluble salt is formed by reaction of cerium carbonate with an appropriate acid.

9. The solution of claim 1, wherein said rare earth element is cerium, present at a concentration in the range from 0.01 to 0.5 mol/litre.

10. The solution of claim 1, wherein said peroxidic compound is selected from the group consisting of peroxo acids, peroxo salts and peroxo compounds, and is preferably hydrogen peroxide.

11. The solution of claim 1, wherein the amount of the peroxidic compound, calculated as equivalent amount of hydrogen peroxide, is in the range front 1 to 200 g/l, preferably 1 to 100 g/l, more preferably 2 to 50 g/l, more preferably 3.4 to 34 g/l.

12. The solution of claim 1, wherein the concentration of at least one said accelerator additive is in the range from 0.0001 to 1.2 g/l, preferably from 0.001 to 1 g/l, more preferably from 0.005 to 0.1 g/l, more preferably from 0.01 to 0.06 g/l.

13. The solution of claim 1, wherein the total concentration of the accelerator additive is from 0.0001 to 0.15 g/l.

14. The solution of claim 1, wherein the accelerator additive is in a concentration range from 0.01 to 5 mmol/litre, preferably from 0.02 to 5 mmol/litre.

15. The solution of claim 1, wherein the accelerator additive is present in solution as a complexed species, wherein the complexing agent is preferably an amino carboxylic acid, such as glycine, alanine and/or glycinethyl ester, ethylenediaminetetraacetic acid (EDTA), nitriloacetic acid (NTA), hydroxyethylenediaminetriacetic acid (HEDTA) and/or corresponding salts thereof, more preferably glycine.

16. The solution of claim 1, wherein the accelerator additive is present in solution as an uncomplexed species.

17. The solution of claim 1 having a pH value from 1.0 to 2.9, preferably from 1.7 to 2.5, more preferably from 1.9 to 2.2.

18. The solution of claim 1, wherein the metallic material is aluminium or aluminium alloy and the solution contains not more than 500 mg/l nitrate content, preferably not more than 300 mg/l, more preferably not more than 200 mg/l, particularly preferred not more than 50 mg/l.

19. The solution of claim 1, wherein the rare earth element is cerium, said accelerator additive is copper and said peroxidic species is a peroxidic compound, said solution further containing sulphate and/or sulphamate species and at least 50 mg/l of chloride.

20. The solution of claim 1, wherein said rare earth element is cerium and said peroxidic species is hydrogen peroxide.

21. A liquid acidic aqueous concentrate for the make-up of an aqueous acidic solution, wherein said concentrate includes at least 125 g/litre of at least one total rare earth element containing species; an accelerator additive selected from the group consisting of metals of Groups IB. IIB, IVA, VA, VIA and VIII of the Periodic Table, preferably selected from the group of Cu, Ag, Sn, Pb, Sb, Bi, Se and Te, preferably Cu; a peroxidic species; at least one acid selected from the group consisting of mineral acids, carboxylic acids, sulphonic acids and phosphonic acids; a total chloride concentration within the range of from 30 to 1500 mg/litre; no more than 100 mg/litre each of fluoride and of phosphate; and said concentrate is substantially free of chromate.

22. A liquid acidic aqueous concentrate for the replenishing of an aqueous acidic solution for forming a conversion coating on the surface of a metallic material, said concentrate containing at least one rare earth element containing species; at least one accelerator additive selected from the group consisting of Cu, Ag, Sn, Pb, Sb, Bi, Sc and Te and anions such that the molar ratio of the sum of the clement in this group; anions is in the range from 1:50 to 1:10,000; a peroxidic species; at least one acid selected from the group consisting of mineral acids, carboxylic acids; sulphonic acids and phosphonic acids; a total chloride concentration within the range of from 30 to 1500 mg/litre; no more than 20 mg/litre each of fluoride and of phosphate; and said concentrate is substantially free of chromate.

23. An aqueous acidic solution for forming a conversion coating on the surface of a metallic material, said solution containing at least one rare earth element containing species, an accelerator additive selected from the group consisting of metals of Groups IB, IIB, IVA, VA, VIA and VIII of the Periodic Table, a peroxidic species and at least one acid selected from the group consisting of mineral acids, carboxylic acids, sulphonic acid and phosphonic acids, and a total chloride concentration within the range of from 30 to 1500 mg/litre, wherein said solution contains no more than 20 mg/litre each of fluoride and of phosphate, and the solution Is substantially free of chromate, wherein said solution contains no significant amount of Fe and no intentional addition of Fe to the solution.

24. The solution of claim 23, wherein the solution contains a maximum Fe content of about 5 mg/litre.

* * * * *

UNITED STATES PATENT AND TRADEMARK OFFICE

CERTIFICATE OF CORRECTION

PATENT NO. : 6,755,917 B2
DATED : June 29, 2004
INVENTOR(S) : Simon Gerard Hardin et al.

It is certified that error appears in the above-identified patent and that said Letters Patent is hereby corrected as shown below:

Column 23,
Line 10, please kindly delete "Sc" and insert -- Se --.

Signed and Sealed this

Thirtieth Day of November, 2004

JON W. DUDAS
*Director of the United States Patent and Trademark Office*